US005231459A

United States Patent [19]

Jang et al.

[11] Patent Number: 5,231,459

[45] Date of Patent: Jul. 27, 1993

[54] LASER BEAM PRINTER WITH NO PAPER SUPPLY CASSETTE

[75] Inventors: Sun T. Jang, Seochoku; Myung H. Noh, Kangnamku, both of Rep. of Korea

[73] Assignee: Hyundai Electronics Industries, Kyoungkido, Rep. of Korea

[21] Appl. No.: 779,974

[22] Filed: Oct. 21, 1991

[30] Foreign Application Priority Data

Oct. 25, 1990 [KR] Rep. of Korea ..... 1990-17171

[51] Int. Cl.[5] ..... G03G 21/00

[52] U.S. Cl. ..... 355/321; 346/160.1; 355/200; 355/309

[58] Field of Search ..... 355/308, 309, 321, 200, 355/210; 346/160.1, 160; 271/223, 224, 241

[56] References Cited

U.S. PATENT DOCUMENTS

| | | | |
|---|---|---|---|
| 4,328,963 | 5/1982 | DuBois et al. | 271/293 |
| 4,332,377 | 6/1982 | DuBois et al. | 271/293 |
| 4,466,608 | 8/1984 | DuBois et al. | 271/293 |
| 4,466,609 | 8/1984 | Lawrence | 271/293 |
| 4,754,293 | 6/1988 | Aizawa et al. | 346/160 |
| 4,768,063 | 8/1988 | Kunishima et al. | 355/321 X |
| 4,911,424 | 3/1990 | Lawrence | 271/293 |
| 4,968,016 | 11/1990 | Koyama | 271/9 |
| 4,982,945 | 1/1991 | Marasco et al. | 271/223 X |
| 5,001,516 | 3/1991 | Maruyama et al. | 355/200 X |
| 5,027,152 | 6/1991 | Oda et al. | 355/200 |
| 5,048,820 | 9/1991 | Chung et al. | 271/293 |
| 5,049,940 | 9/1991 | Yamaguchi et al. | 355/260 |
| 5,083,170 | 1/1992 | Sawada et al. | 355/200 X |

FOREIGN PATENT DOCUMENTS

| | | |
|---|---|---|
| 60-232370 | 11/1985 | Japan . |
| 89-8291 | 1/1991 | Rep. of Korea . |
| 90-18264 | 5/1992 | Rep. of Korea . |
| 2168037 | 6/1986 | United Kingdom . |

*Primary Examiner*—A. T. Grimley
*Assistant Examiner*—Nestor R. Ramirez
*Attorney, Agent, or Firm*—Darby & Darby

[57] ABSTRACT

A laser beam printer with no paper supply cassette comprising a main body 100 provided with a laser scanning unit 1 for converting an electric signal into a laser beam and scanning the laser beam, a fixation part 10 for fixing the developed paper, a developing part 5 and 6 disposed at a front of the laser scanning unit 1 and adapted for developing an image on a paper, a front cover 19 for supplying the paper and covering the main body 100 and mounted to a side of the main body 100 by a hinged connection 30 mounted to a lower portion of the main body 100 in order to connect the cover 19 to the main body 100, a guide slot 20 for allowing the developing part 2 and 6 to be disposed thereto, and a paper discharge unit 11 for discharging the paper having been fixed and comprising a pair of paper discharge rollers 26 and 27 and a discharging type select roller 25.

8 Claims, 3 Drawing Sheets

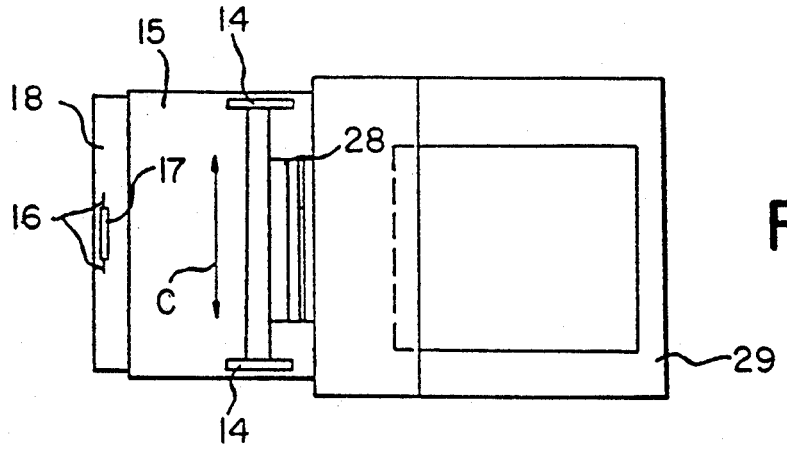
FIG. 1a
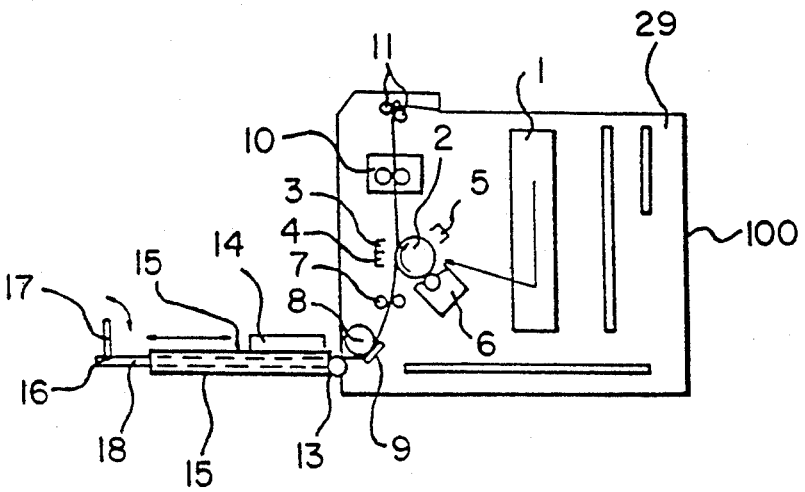
FIG. 1b
FIG. 1c
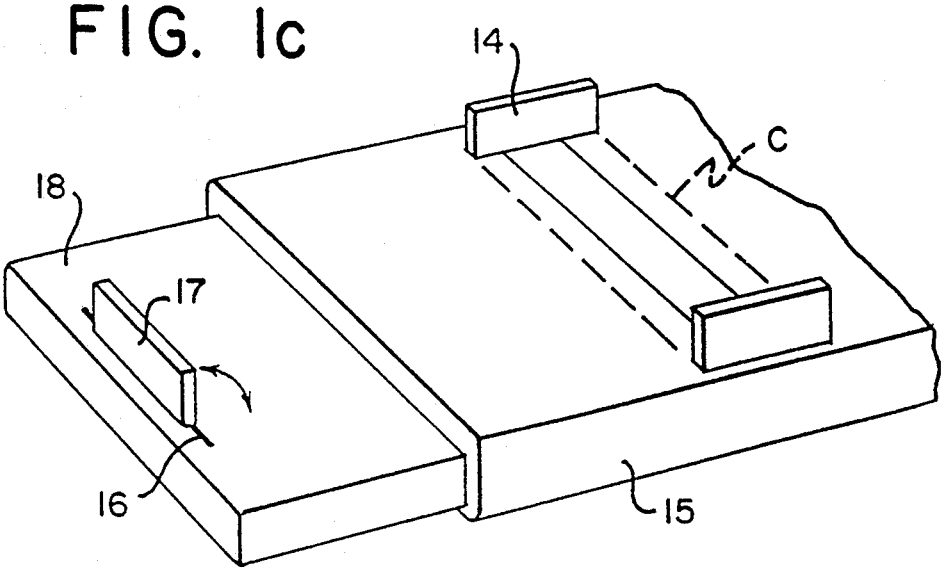

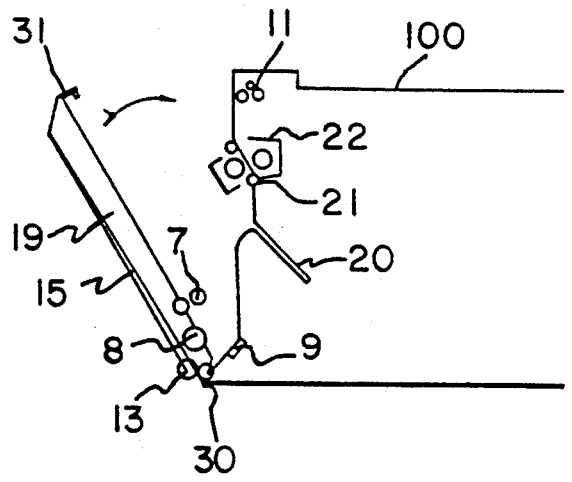
FIG. 2
FIG. 3a
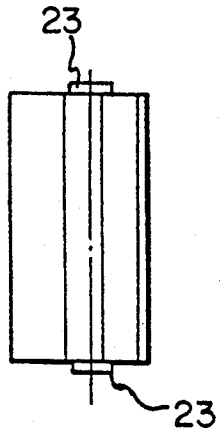
FIG. 3c
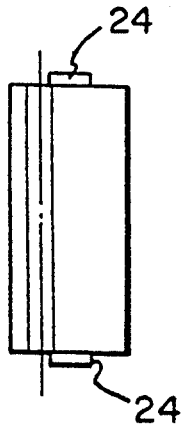
FIG. 3b
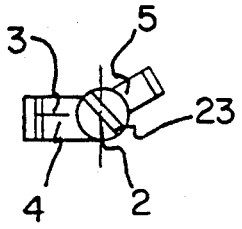
FIG. 3d
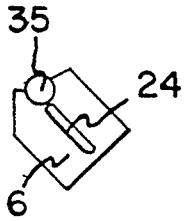

FIG. 4a
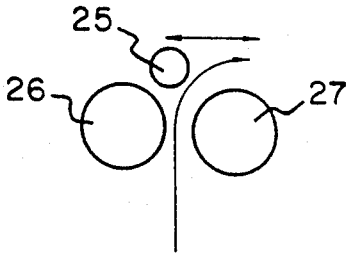
FIG. 4b
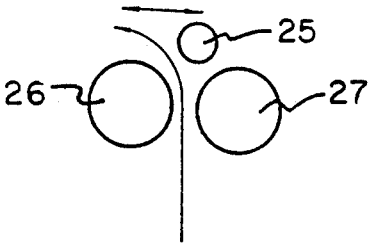
FIG. 5a
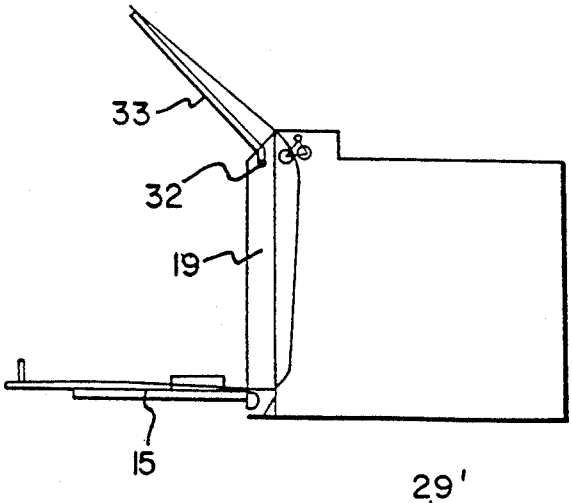
FIG. 5b
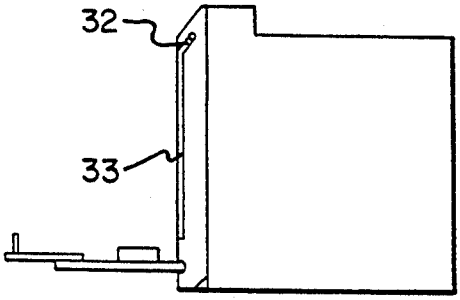
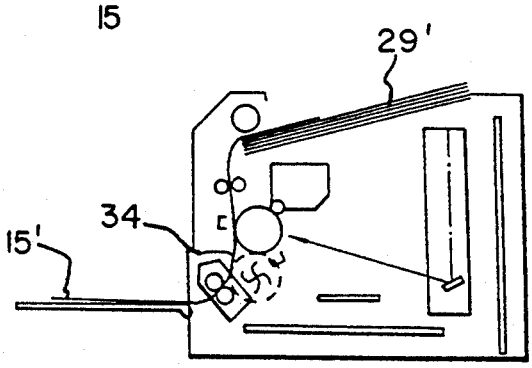
FIG. 6a
FIG. 6b
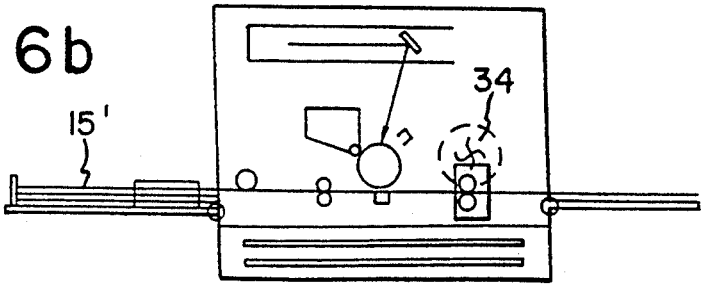

LASER BEAM PRINTER WITH NO PAPER SUPPLY CASSETTE

BACKGROUND OF THE INVENTION

1. Field of the Invention

The present invention relates to a laser beam printer utilizing an electrophotography, and more particularly to a laser beam printer with no paper supply cassette.

2. Description of the Prior Art

Conventionally, such a laser beam printer utilizing an electrophotography is equipped with cassettes or trays which are mounted to one side or top of the printer, in order to accomplish the supply of papers. However, these cassettes and trays each has a specific size, resulting in limiting free selection of various sizes of papers. Due to the protruded length of such paper supply device, the length or the height of the overall construction of printer is increased, thereby causing the occupation space to increase undesirably. On the other hand, papers supplied from the paper supply device are fed into the interior of the printer, by a plurality of rollers. After passing through a developing system and a fixation part in the printer, papers are discharged from the printer by paper discharging rollers and a discharging tray. During the feeding of papers, jamming of papers in the printer often occurs. At this time, an upper frame to which the developing system and the fixation part are mounted or several cover members should be lifted for removing the jammed paper from the printer and then be returned to their original positions at which they are operatively connected to the printer, by being depressed by a strong pressure or a separate connecting device. This operation for removing jammed papers is troublesome and uneasy. Furthermore, there is a disadvantage that due to impacts and movements occurring in connecting the upper frame or cover members to the printer again, abrasion and damage of various parts and inner construction of the printer may be generated. In addition, the optical system and the developing system lost their accuracy, thereby causing print files to be badly produced and operating parts to be frequently out of order.

The discharging tray may be easily separated from the printer due to the operator's carelessness and thereby damaged. In addition, it is unfolded or taken out of the printer in printing operation, thereby causing the occupation space of overall construction to be increased.

SUMMARY OF THE INVENTION

Therefore, an object of the invention is to provide a laser beam printer with no paper supply cassette, enabling the occupation space of overall construction thereof to be reduced.

Another object of the invention is to provide a laser beam printer enabling free selection of various sizes of papers, without using any paper supply cassette.

Another object of the invention is to provide a laser beam printer enabling its overall construction to be compact.

Another object of the invention is to provide a laser beam printer wherein when jamming of papers occurs, it can be easily overcome.

Another object of the invention is to provide a laser beam equipped with a simple and convenient paper discharging device having no paper discharging tray.

Another object of the invention is to provide a laser beam enabling easy convenient replacement of its developing system.

In accordance with the present invention, these objects can be accomplished by providing a laser beam printer comprising a main body provided with a laser scanning unit for converting an electric signal into a laser beam and scanning said laser beam; a fixation part for fixing said paper having been developed, said laser beam printer further comprising: a developing part disposed at a front of said laser scanning unit and adapted for developing an image on a paper; means for supplying the paper to said main body of the laser beam printer and covering the main body, said means mounted to a side of the main body by means of a hinged connection mounted to a lower portion of the main body in order to connect the means to said main body, thereby allowing the means to be opened as required; means for allowing said developing part to be disposed thereto, said means provided at a front of the laser scanning unit and comprising a guide slot formed at the main body; and a paper discharge unit for discharging the paper having been fixed, said unit disposed at a portion of an upper cover of the main body over said fixation part.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* each is a schematic view showing a laser beam printer in accordance with this invention, in which:

FIG. 1*a* is a plane view; and

FIG. 1*b* is a side view;

FIG. 1*c* is a schematic perspective view of a bracket which is slidably movable in a lateral direction within a cover in accordance the laser beam printer of FIGS. 1*a* and 1*b*.

FIG. 2 is a schematic view showing an open state of a front cover of the laser beam printer of this invention;

FIGS. 3*a*–3*d* are schematic top and end plan views showing a construction of a compact developing system of the laser beam printer of this invention;

FIGS. 4*a* and 4*b* are schematic views each showing a construction of the paper discharge roller unit, in which:

FIG. 4*a* shows a face-down type discharging; and

FIG. 4*b* shows a face-up type discharging;

FIGS. 5*a* and 5*b* each is a side view of the laser beam printer of the invention for showing a paper receiving tray and a paper discharge roller unit in case of the face-up discharging type, in which:

FIG. 5*a* shows an open state of the tray; and

FIG. 5*b* shows a closed state of the tray;

FIGS. 6*a* and 6*b* are schematic sectioned side views for showing constructions of another embodiments of a laser beam printer in accordance with this invention.

DETAILED DESCRIPTION OF THE PREFERRED EMBODIMENTS

Referring to FIGS. 1*a* and 1*b*, there is shown a laser beam printer in accordance with the present invention. The laser beam printer comprises a main body 100 and a paper supply cover 15 mounted to a paper supplying side of the main body 100 and openable with respect thereto by means of a hinged connection 13 which is mounted between an inner side of the cover 15 and a lower portion of the paper supply side of the main body 100 in order to connect the cover 15 to the main body 100. The main body 100 encloses at a center portion thereof a compact laser scanning unit 1 for scanning a laser beam to a developing system.

As described shown in the drawings of FIGS. 1*a*, 1*b*, 1*c*, the paper supply cover 15 is provided with a paper size control bracket 18 which is movably mounted to the cover 15 in order to be movable in a lateral direction of the cover 15. The bracket 18 has a paper stopper 17 which is longitudinally provided therewith so as to be folded with a snap with respect to the bracket 18 by means of a hinged connection 16. Therefore, the lateral movement of the bracket 18 causes the paper stopper 17 to move laterally so that the stopper 17 moves by virtue of the bracket 18 in order to accommodate the lateral size of the paper irrespective of a size of the paper and contact with the free ends of the papers so as to support the papers to prevent them from being scattered.

In addition, the paper supply cover 15 is provided with a pair of lateral paper guides 14 which are movable in a longitudinal direction (represented at the vertical arrow mark "c" in FIGS. 1*a* and 1*c* of the cover 15 in order to efficiently contact with both sides of the papers irrespective of the width size of the papers. The longitudinal movement of the paper guides 14 with respect to the paper supply cover 15 is accomplished by a guide slot (not shown) formed on the paper supply cover 15 and providing a connection between the paper supply cover 15 and the lateral paper guides 14. Thus, the papers is accommodated on the paper supply cover 15 by virtue of the movement of the guides 14 and the stopper 17. The paper supply cover 15 is also provided thereon near the hinged connection 13 with a support plate 28 which elastically forces upwards the papers in order to allow the papers to stably maintain their height, at which height the papers are drawn one by one by the paper supply roller 8 into the main body 100.

As described in FIG. 1*b*, the main body 100 is provided with a frictional plate 9 disposed under the paper supply roller 8 in order to frictional contact with the roller 8 as the roller 8 rotates. Thus, the supply roller 8 draws the papers one by one by cooperation with the frictional plate 9, thereby preventing two or more papers from being drawn at the same time.

The main body 100 is also provided with a pair of register rollers 7 facing with each other and disposed above the paper supply roller 8 in order to draw the paper as it is synchronized with an electric signal. The paper then passes by the drum set 2 and the fixation part 10 in order to develop the image on the paper and fix the image of the paper. At this time, the laser scanning unit 1 which is stably enclosed in the main body 100 of the laser beam printer scans a laser beam to the drum set 2 disposed at the front thereof. Upon receiving an electric signal corresponding to an image which is to be developed on the paper, the laser scanning unit 1 generates the laser beam corresponding to the image and scans the beam to the drum set 2. The fixed paper thereafter passes by a paper discharge roller unit 11, comprising a plurality of rollers, in order to be discharged onto the upper cover of the upper frame of the main body or a paper receiving tray.

Referring next to FIG. 2 which is a schematic view showing the open state of a front cover 19 of the laser beam printer of this invention, the main body 100 includes a front cover 19 which is connected thereto by means of a hinged connection 30 in an openable type. Additionally, a pair of guide slots 20 are provided to the main body 100 for allowing a compact developing system comprising the drum set 2 and the developer set 6 to be disposed therein in a slip type. The fixation part 10 and the paper discharge roller unit 11 are orderly disposed over the developing system.

On the other hand, the front cover 19 is connected to the lower portion of the main body by means of a hinged connection 30 so that the front cover 19 can be easily opened with respect to the main body by means of the hinged connection 30 as required, said hinged connection 30 mounted near the hinged connection 13 which connects the paper supply cover 15 to the main body 100. The front cover 19 is provided at its free end with an elastic clip 31 for allowing the user to open the front cover 19 by pressing the clip 31. Therefore upon pressing the clip 31, the user pulls the front cover 19 toward him, thereby causing the front cover 19 to turn about the hinged connection 30 and opening the front cover 19. The register rollers 7 and the paper supply roller 8 are mounted to the front cover 19.

The fixation part 10 is also provided with an openable clip 22 which surrounds the part 10 and is openable about a hinged connection 21 in order to cause the fixation part 10 to be opened. Therefore, if there is a jamming of the paper on the fixation part 10, the user first opens the front cover 19 by forcedly pulling toward him under the condition of pressing the clip 31. Upon opening the front cover 19, the user presses the clip 22 downwards in order to turn the clip 22 counterclockwise about the hinged connection 21, thereby allowing the fixation part 10 to be opened. Thus, the jammed paper can be easily removed from the fixation part 10. In addition, if there is a necessity of disassembling the compact developing system comprising the drum set 2 and the developer 6 in order to change the parts thereof or provide it with toner, the user first opens the front cover 19 in the same manner as described above, and then easily disassembles the developing system from the guide slot 20.

Referring to FIGS. 3*a*–3*d* which are schematic views showing a construction of the compact developing system of this invention, the system comprises two parts, the drum set 2 (FIGS. 3*a* and 3*b*) and the developer set 6 (FIGS. 3*a* and 3*b*). The drum set 2 comprises a divider 3, a transfer member 4, a charged member 5 and a guide 23, while the developer set 6 comprises a guide 24 and a sleeve 35. The drum set 2 and the developer set 6 are orderly mounted in the guide slot 20 of the main body 100 in the slip type, thereby securing their stable positions in the slot 20.

FIGS. 4 are schematic views each showing a construction of the paper discharge roller unit 11, in which FIG. 4*a* shows face-down type discharging and FIG. 4*b* shows face-up type discharging. As described in these drawings, the paper discharge roller unit 11 comprises a pair of paper discharge rollers 26 and 27 facing with each other, and a discharging type select roller 25 disposed above the discharge roller 26 and 27.

As described in FIG. 4*a*, the select roller 25 shifts toward the left discharge roller 26 in order to cause the fixed paper to be rightward discharged. In this face-down type of discharging, the paper is discharged under the condition that a paper surface having the developed and fixed image is directed upwards in order to be exposed to the user, thereby allowing the user to check the printing state of image. The discharged papers in the face-down type discharging are received by the upper cover 29 of the main body 100. However, if the select roller 25 shifts toward the right discharge roller 27 as shown in FIG. 4*b*, the paper discharge roller unit 11 accomplishes the face-up type discharging. In this face-up type of discharging, the paper is discharged under the condition that the paper surface having the developed and fixed image is directed downwards so that the papers can be piled up in page order, while the paper surface having the developed and fixed image can not be exposed to the user. The discharged papers in the face-up type discharging are received by a paper receiving tray 33. The paper receiving tray 33 is selectively mounted to the upper portion of the front cover 19 of the main body 100.

FIGS. 5*s* and 5*b* each is a side view of the laser beam printer of this invention for showing the paper receiving tray 33 and the paper discharge roller unit 11 in case of the face-up discharging type, in which FIG. 5*a* shows an open state of the tray 33, while FIG. 5*b* shows a closed state thereof.

As described in these drawings, the paper receiving tray 33 is connected to the front cover 19 by means of a hinged connection 32. The hinged connection 32 is mounted to an upper portion of the front cover 19 in order to allow the tray to be turned clockwise thereabout. Therefore, in case of necessity of using the tray 33 due to selecting the face-up type discharging, the user first opens the paper supply cover 15 and then turns the tray 33 clockwise about the hinged connection 32, and thereafter fixes the tray 33 to be maintained in the open state.

Referring to FIGS. 6*a* and 6*b* which are schematic sectioned side views for showing constructions of another embodiments of a laser beam printer in accordance with this invention, the laser beam printer may be provided with an upper cover 29', as shown in FIG. 6*a*, having a form of a paper supply cassette for providing a function of the paper supply cassette. Therefore in this second embodiment, the paper is supplied to the printer from the upper portion of the main body 100 and then discharged from a front portion of thereof. In addition, the printer of this embodiment may be provided with a front cover having a function as a paper receiving tray for receiving the discharged papers. On the other hand, the laser beam printer of this invention may be provided as shown in FIG. 6*b* with a paper supply cover 15' having a function as a paper supply cassette, and an openable back cover having a function as a paper receiving tray. In this third embodiment, the paper is transferred horizontally as shown in FIG. 6*b*. In the drawings, the reference numeral 34 denotes a blower disposed near the fixation part.

As described above, the laser beam printer according to this invention provides advantages in that it is provided with a paper supply cover on which several sizes of papers are easily and stably contained by easy repositioning of a movable paper size control bracket and a pair of movable paper guides each provided thereon, and the printer accomplishes a compact size resulting in facility in removing a paper jammed on a fixation part thereof by virtue of easy opening of the front cover. The laser beam printer of this invention is provided with a laser scanning unit disposed inside the main body, thereby easily protecting the laser scanning unit, and provided with a compact developing system, thereby providing facility in changing and disassembling the elements. In addition, the laser beam printer of this invention provides another advantages in that it has no paper supply cassette and paper receiving tray, thereby improving the using life and reliability of the printer.

Furthermore, the laser beam printer of this invention provides another advantage in that the paper discharging can be easily carried out in a face-up discharging type or a face-down discharging type by controlling the position of paper discharge roller unit.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A laser beam printer with no paper supply cassette, comprising a main body provided with a laser scanning unit for converting an electric signal into a laser beam and for scanning with said laser beam, the main body having an open front;

a developing part, disposed at a front of said laser scanning unit, for developing an image on paper;

a fixation part for fixing the paper after the image has been developed;

supply and cover means for supplying the paper to said main body and for covering the open front of the main body, said supply and cover means including a paper supply cover provided with a paper size control bracket which is movable in a lateral direction of the paper supply cover for supporting the paper irrespective of a lateral size of the paper, a paper stopper which is provided at the paper size control bracket, connection means for hingably connecting the paper stopper to the paper size bracket so that the paper stopper may be folded with respect to the paper size bracket and for contact with free ends of the paper, a pair of lateral paper guides which are movable in a longitudinal direction for contacting both sides of the paper, said lateral paper guides being movably connected to the paper supply cover so as to be movable towards and away from each other;

hinged connection means for mounting said supply and cover means to a side of the main body so as to allow the supply and cover means to be opened as required and thereby provide access to the open front of the main body;

guide means for guiding said developing part into position in front of the laser scanning unit, said guide means including a guide slot formed by the main body, said guide means also including guides on the developing part which cooperate with said guide slot for guiding the developing part relative to the main body in front of the laser scanning unit; and a paper discharging unit for discharging the paper after the paper has been fixed, said paper discharging unit being disposed at a portion of an upper cover of the main body over said fixation part.

2. A laser beam printer according to claim 1, wherein said developing part comprises two parts, one of the two parts being a drum set part which comprises a divider, a transfer member, a charged member and a first of the guides, the other of the two parts being a developer set part comprising a second of the guides and a sleeve.

3. A laser beam printer with no paper supply cassette, comprising a main body provided with a laser scanning unit for converting an electric signal into a laser beam and for scanning with said laser beam, the main body having an open front;

a developing part, disposed at a front of said laser scanning unit, for developing an image on paper;

a fixation part for fixing the paper after the image has been developed;

supply and cover means for supplying the paper to said main body and for covering the open front of the main body;

hinged connection means for mounting said supply and cover means to a side of the main body so as to allow the supply and cover means to be opened as required and thereby provide access to the open front of the main body;

guide means for guiding said developing part into position in front of the laser scanning unit, said guide means including a guide slot formed by the main body, said guide means also including guides on the developing part which cooperate with said guide slot for guiding the developing part relative to the main body in front of the laser scanning unit; and a paper discharging unit for discharging the paper after the paper has been fixed, said paper discharging unit being disposed at a portion of an upper cover of the main body over said fixation part, said paper discharging unit comprising a pair of paper discharge rollers facing each other, and a discharging type select roller disposed above said paper discharge rollers in order to be displaced between two positions each being nearer a respective one of the paper discharge rollers than to the other of the paper discharge rollers.

4. A laser beam printer according to claim 1, wherein said supply and cover means is provided with a paper supply roller for drawing papers into the main body one by one; a pair of register rollers facing with each other and disposed above the supply roller in order to draw the paper having passed by said supply roller as the register rollers are synchronized with an electric signal.

5. A laser beam printer according to claim 1, wherein said fixation part is provided with an openable clip and a hinged connection about which said clip is turned in order to be opened, said clip surrounding the fixation part, thereby allowing the fixation part to be opened downwards in frontward direction.

6. A laser beam printer according to claim 2, wherein the fixation part is at an elevation higher than that of the drum set part.

7. A laser beam printer with no paper supply cassette, comprising a main body provided with a laser scanning unit for converting an electric signal into a laser beam and for scanning with said laser beam, the main body having an open front;

a developing part, disposed at a front of said laser scanning unit, for developing an image on paper;

a fixation part for fixing the paper after the image has been developed;

supply and cover means for supplying the paper to said main body and for covering the open front of the main body, hinged connection means for mounting said supply and cover means to a side of the main body so as to allow the supply and cover means to be opened as required and thereby provide access to the open front of the main body, the supply and cover means including a paper supply cover mounted by the hinged connection means to the main body, two lateral paper guides mounted on the cover so as to be movable towards and away from each other for contacting opposite sides of the paper, a paper size control bracket movable in a lateral direction of the paper supply cover, and paper stopper extending from the paper size control bracket, said paper size control bracket being movable in the lateral direction for positioning the paper stopper at a location for contacting an end of the paper;

guide means for guiding said developing part into position in front of the laser scanning unit, said guide means including a guide slot formed by the main body, said guide means also including guides on the developing part which cooperate with said guide slot for guiding the developing part relative to the main body in front of the laser scanning unit; and a paper discharging unit for discharging the paper after the paper has been fixed, said paper discharging unit being disposed at a portion of an upper cover of the main body over said fixation part.

8. A laser beam printer according to claim 7, further comprising hinged connection means for hingably connecting the paper stopper to the paper size control bracket for enabling the paper stopper to be folded with respect to the paper size control bracket.

* * * * *